United States Patent [19]

Smith et al.

[11] 4,078,402

[45] Mar. 14, 1978

[54] KNITTING APPARATUS AND YARN TRAPPER

[75] Inventors: Donald Smith, Ilkley; Geoffrey Darnborough, Wetherby, both of England

[73] Assignee: I.W.S. Nominee Company Limited, London, England

[21] Appl. No.: 831,182

[22] Filed: Sep. 7, 1977

[30] Foreign Application Priority Data

Jun. 27, 1977 United Kingdom ..... 26862/77

[51] Int. Cl.[2] ..... D04B 35/00

[52] U.S. Cl. ..... 66/145 R; 66/82 R; 66/129; 66/136

[58] Field of Search ..... 66/125, 129, 134, 128, 66/140, 142, 145, 136, 135, 82 R

[56] References Cited

U.S. PATENT DOCUMENTS

| | | | |
|---|---|---|---|
| 1,978,409 | 10/1934 | Carlson | 66/135 |
| 2,216,051 | 9/1940 | Smith | 66/128 |
| 2,529,207 | 11/1950 | Woolley | 66/128 |

*Primary Examiner*—Ronald Feldbaum
*Attorney, Agent, or Firm*—Harold L. Stowell

[57] ABSTRACT

An attachment having a knitting machine including at least two toothed members slidable in relationship to one another such that when the teeth are aligned yarn receiving openings are presented and on sliding the members relative to one another yarns within the yarn receiving openings are gripped by adjacent teeth.

5 Claims, 2 Drawing Figures

KNITTING APPARATUS AND YARN TRAPPER

REFERENCE TO RELATED APPLICATION

Related subject matter is disclosed and claimed in application Ser. No. 700,053 filed June 25, 1976 for "Knitting Apparatus" by Donald Smith, which application is now allowed.

Priority of British application No. 26862/77 filed June 27, 1977 is hereby claimed under 35 U.S.C. 119.

BACKGROUND OF THE INVENTION

This invention relates to a device for controllably gripping yarns or threads.

In copending U.S. application Ser. No. 700,053 filed June 25, 1976 and now allowed, there is disclosed an apparatus for introducing patterning warp threads into a fully fashioned garment panel during knitting. This apparatus is capable of producing a wide variety of walewise patterns, e.g. stripes, diamonds and zig-zags, on garment panels, especially sweater panels. Reference will be made to said application hereinafter and the disclosure of said application is made a part hereof.

Prior to this invention, after each panel had been knitted, it was necessary for an operative manually to hold the warp threads after cutting them to free the knitted panel; and thereafter to align the warp ends with the appropriate needles to knit the next succeeding panel.

This invention seeks to provide a device capable of releasably gripping the warp ends and moving them selectively into or out of the knitting position.

BRIEF SUMMARY OF THE INVENTION

According to the present invention there is provided a device for gripping threads which comprises at least two toothed members arranged side-by-side and slidable in relation to one another in such a manner that, when the teeth are in alignment, yarn-receiving openings are presented and on sliding the members relative to one another yarns within such openings are gripped by adjacent teeth.

The device may be operable to move into and out of the knitting zone and is preferably shaped so as not to impede the operation of any of the knitting elements, e.g., the needles or sinkers.

Advantageously, the device is operable automatically, whether by means of mechanical devices such as cams, or otherwise, in timed relationship with the knitting cycle. When used in conjunction with the apparatus of co-pending application Ser. No. 700,053, the device conveniently grips the warp yarns and brings them into the knitting zone at the start of a knitting cycle and then releases them, returning to re-engage the yarns and carry them away from the knitting zone at the end of the cycle.

REFERENCE TO THE ACCOMPANYING DRAWINGS

An example of the device of the invention designed for operation with the patterning apparatus of application Ser. No. 700,035 will now be described. For simplicity, the operation of the patterning apparatus will be omitted except insofar as it directly relates to the present embodiment of the present invention.

In the accompanying drawings:

FIG. 1 is a partial diagrammatic front elevation of a fully fashioned knitting machine incorporating the apparatus of application Ser. No. 700,053 and the device of the invention; and FIG. 2 is a section taken on line II—II in FIG. 1.

DESCRIPTION OF THE PREFERRED EMBODIMENT

Figure 1:
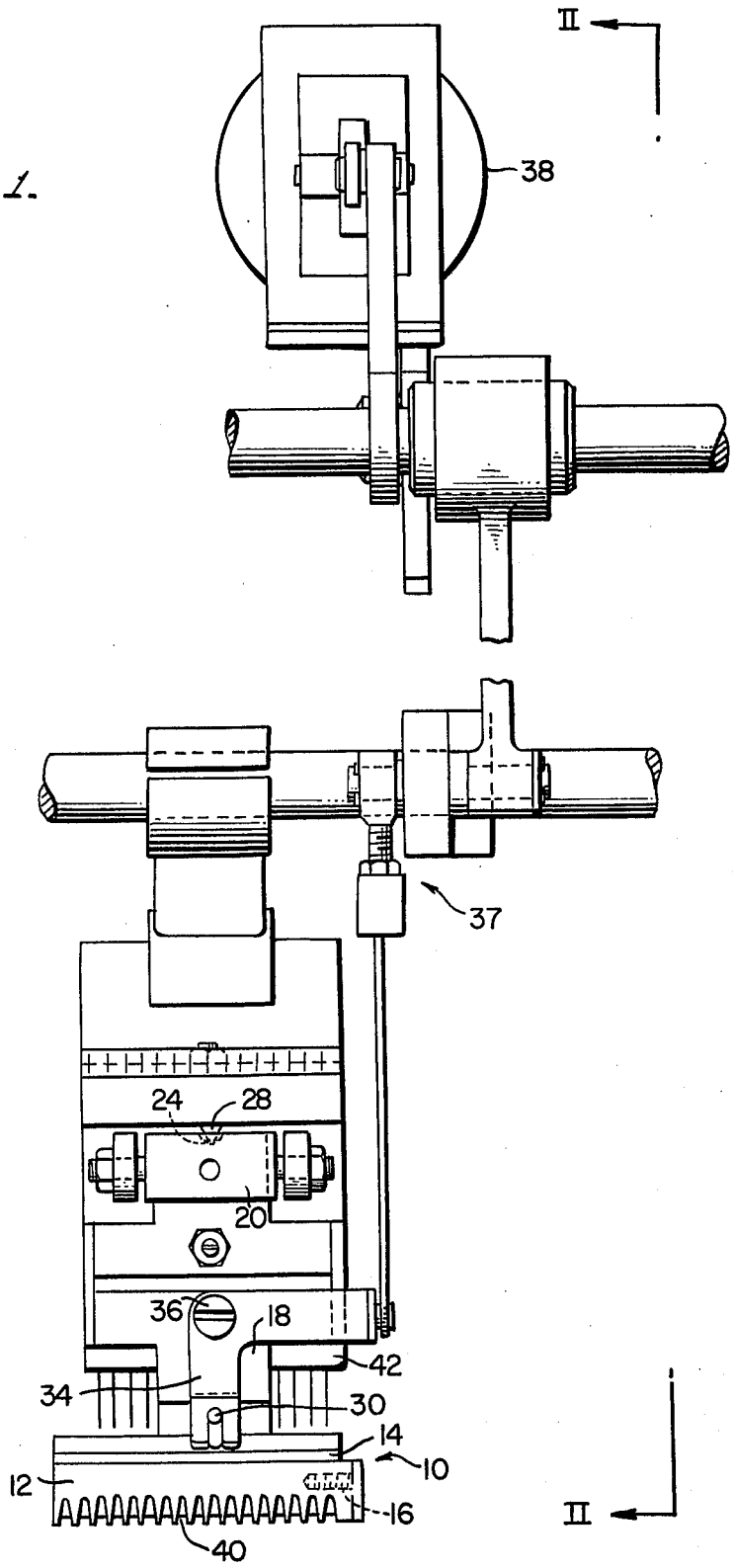
Figure 2:
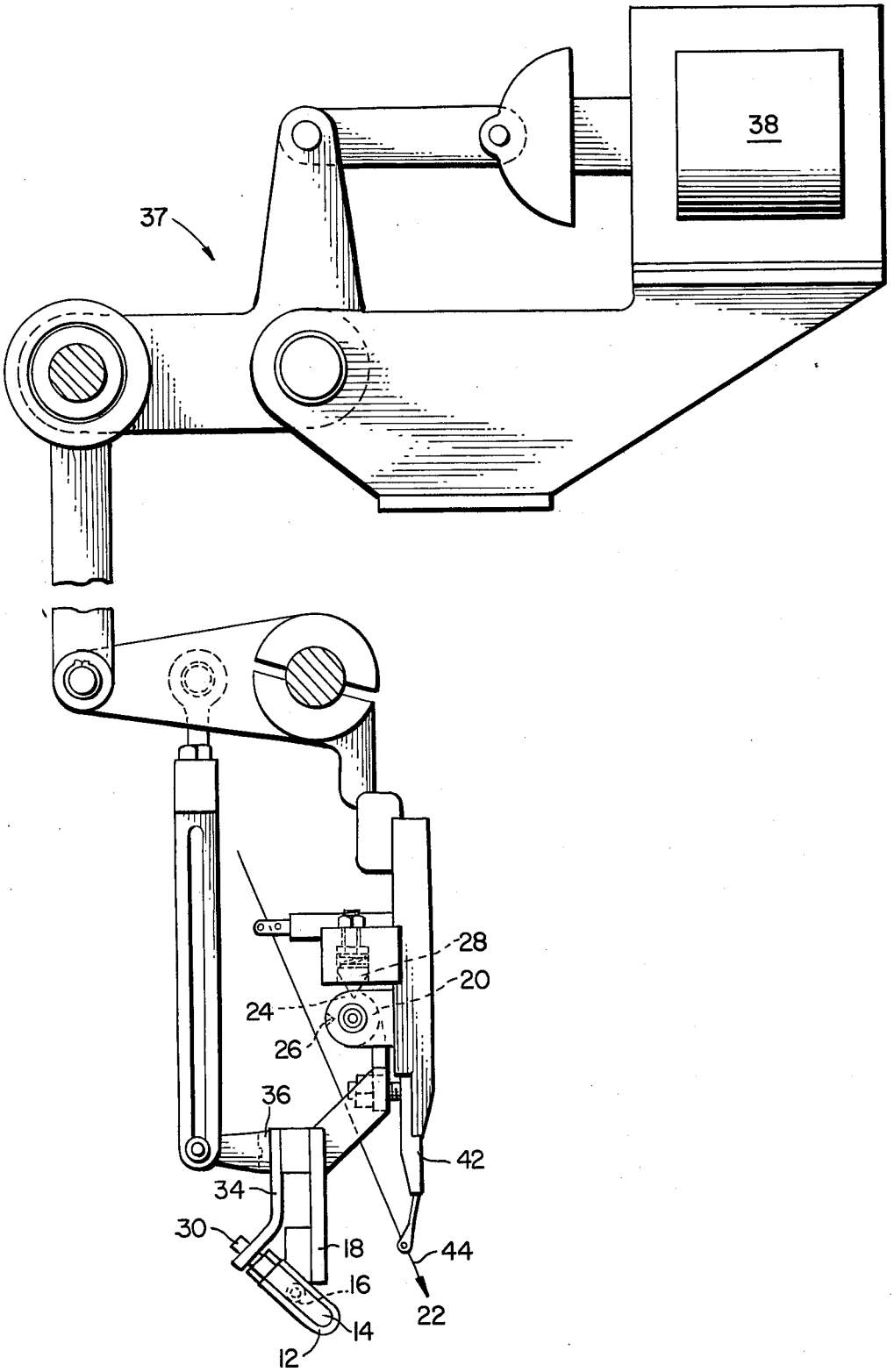

Referring to the drawings, the gripping device 10 comprises an outer toothed member 12 and an inner toothed member 14 which are relatively slidable and are biased to the position shown in FIG. 1 by a spring 16. The outer member 12 is fixed to and supported by a bracket 18 which in turn is attached to part of the machine frame through a bearing 20. The bracket 18 and the device supported thereon can be swung away from knitting zone 22, pivoting about the bearing 20. The bearing has two indentations 24, 26 designed to receive a spring-loaded locating plunger 28 to lock the device in the operative position (as shown) or in the swung-back position.

The inner toothed member 14 has an operating peg 30 received in a slot 32 in an operating lever 34 pivotally mounted at 36. The lever 34 is connected through a series of levers, whose exact disposition depends on the model of fully fashioned knitting machine to which the device is attached, to a solenoid 38. When the solenoid is operated, the operating lever 34 is pivoted to the right (as seen in FIG. 1) through the chain of levers, thus displacing the inner toothed member 14 relative to the outer member 12 against the bias of the spring 16 until the teeth are aligned clearing yarn-receiving openings 40. On deactivating the solenoid 38, the toothed members are biased back trapping any yarns in the openings between adjacent teeth on the inner and outer members.

The device operates as follows. The guide block 42 (which corresponds to either of the guide blocks 26, 28 in Ser. No. 700,053) carries warp yarns 44 to the knitting zone 22 where they are plated into the weft knit base fabric producing patterns according to the setting of the machine. When the pattern is finished, the warp yarns are no longer knitted and, as the weft knit fabric is produced, the free yarn ends move further from the knitting zone 22 towards the device 10. The positioning of the device 10 is such that one end of warp yarn aligns with and is received in each yarn-receiving opening 40. The solenoid may then be operated to allow the yarns to enter and be trapped within the openings 40, after which the ends below the device 10 may be cut, the device 10 swung back out of the operating position, and the knitted fabric removed in the normal way.

When it is desired to introduce a pattern into the next subsequent fabric panel to be knitted, the device 10, still gripping the yarns 44, is swung into the operative position and the yarns are then accurately placed in the knitting zone 22. When the guide block 42 is racked sideways at the start of the programmed patterning sequence, the yarns are smoothly taken up by the desired needles and knitted into the fabric.

The warp yarns 44 pass from a beam (not shown) through guides to the eyelets in the guide blocks 42, and thence to the knitting zone 22. When the machine is knitting, say, a garment blank, the warp yarns are knitted into the fabric according to the programming of the machine. On finishing the blank it is removed from the machine, and thus all the yarns, both the (single) weft yarn forming the base fabric and the several warp yarns forming the pattern, must be cut. Without the trapper, once the warp yarns are cut, they just hang loose in a cluster and can become tangled. In any event, they would no longer be aligned with the correct needles; and, when a new garment blank was to be knitted, the operative must on each knitting head align each of warp yarns (up to say 20 to 30) with the correct needles, pass them behind the shanks thereof, and hold them under tension until a course has been knitted, thus anchoring the loose ends of the warp yarns in the fabric. The yarn trapper performs this time-consuming task automatically, on each head simultaneously, in a fraction of the time taken by an operative.

The device 10 is shaped so that it can be positioned close into the knitting zone without interfering with the knitting elements, principally the sinkers. Further, the device and its associated mechanism may be swung up with the guide hooks 42 during a fashioning sequence so as not to interfere with the fashioning operation.

The gripping mechanism may move warp threads out of the way when they are not needed and brings them back into position to be engaged by the needles when designs are to be made. If this is done during the knitting of a single piece of fabric then length of warp yarn (float stitches) will run along the back of the fabric connecting each place where the yarns are knitted in to form a pattern on the front face of the fabric. The float stitches may be left if short (covering, say, 3 or 4 courses); and removed if long, by cutting them from the back of the fabric after it has been removed from the machine. In any event, it is necessary to cut all the knitting yarns (weft and warp) before it is possible to remove the fabric from the machine at all. As an example, to remove a piece of fabric from a warp knitting machine, it is necessary to cut all the warp yarns.

The device eliminates the need for an operative manually to hold the warp ends, after cutting free a knitted panel, and then re-aligning them manually for the next successive panel. The operation of the solenoid may be manual but is preferably programmed together with the conventional programming on a fully fashioned machine.

I claim:

1. A yarn trapper for apparatus for making a weft-knit fabric, and apparatus having auxiliary feeders to feed warp yarn to selected needles, the auxiliary feeders moving during the knitting cycle past the single beard needles and then forward with the warp yarn tensioned so that loops thereof cover the weft loops on the face of the fabric, said trapper comprising means for gripping the warp threads including at least two toothed members side-by-side and slidable with respect to each other to align the teeth in warp yarn receiving openings and to close said openings to grip yarns between adjacent teeth.

2. A trapper as described in claim 1 including means for moving said gripping means into and out of the knitting zone clear of the knitting elements.

3. A trapper as described in claim 1 including automatic means for actuating said gripping means in timed relationship in the knitting cycle gripping the warp yarns and moving the warp yarns into the knitting zone at the start of a knitting cycle and the releasing the warp yarns with subsequent re-gripping of the warp yarns for removal from the knitting zone at the end of the knitting cycle.

4. A trapper as described in claim 1 including spring loaded biasing means for moving said members to yarn gripping position and electric solenoid means for moving said members to provide said yarn receiving openings.

5. A trapper as described in claim 4 including pivoted linkage between solenoid and said members, at least one bearing in said linkage, at least two identations in said bearing and a spring loaded plunger mounted adjacent said bearing and engaging in said indentations to lock said members in the knitting zone and to lock said members in position removed from the knitting zone.

* * * * *